US007896181B1

(12) United States Patent
Francis et al.

(10) Patent No.: US 7,896,181 B1
(45) Date of Patent: Mar. 1, 2011

(54) MULTI-FUNCTIONAL BOTTLE

(76) Inventors: Michael Jay Francis, Morongo Valley, CA (US); Richard M. Ghiloni, Joshua Tree, CA (US)

( * ) Notice: Subject to any disclaimer, the term of this patent is extended or adjusted under 35 U.S.C. 154(b) by 127 days.

(21) Appl. No.: 12/119,322

(22) Filed: May 12, 2008

(51) Int. Cl.
*A61J 9/00* (2006.01)
*B65D 1/04* (2006.01)

(52) U.S. Cl. ..... 215/11.1; 215/6; 215/10; 215/11.6

(58) Field of Classification Search ..... 220/23.87; 215/6, 10, 11.1, 11.6, DIG. 8
See application file for complete search history.

(56) References Cited

U.S. PATENT DOCUMENTS

RE23,434 E * 11/1951 Numbers ..... 141/381
2,793,776 A 5/1957 Lipari
2,843,281 A 7/1958 Gallois
2,885,104 A * 5/1959 Greenspan ..... 206/222
3,219,221 A * 11/1965 Ballin ..... 215/11.6
3,458,076 A * 7/1969 Babcock ..... 215/6
3,613,955 A 10/1971 Wetherell, Jr.
3,870,147 A * 3/1975 Orth ..... 206/222
4,177,938 A * 12/1979 Brina ..... 222/80
4,667,818 A * 5/1987 Evans ..... 206/219
5,029,701 A * 7/1991 Roth et al. ..... 206/232
5,114,011 A * 5/1992 Robbins, III ..... 206/499
5,419,445 A 5/1995 Kaesemeyer
5,433,328 A 7/1995 Baron et al.
5,456,090 A * 10/1995 McCoy ..... 62/372
5,950,689 A 9/1999 Varlet
5,968,971 A * 10/1999 Elliott ..... 514/444
6,059,443 A * 5/2000 Casey ..... 366/130
6,152,296 A * 11/2000 Shih ..... 206/222
6,189,688 B1 * 2/2001 Aneas ..... 206/219
D441,087 S 4/2001 Johansen et al.
6,305,576 B1 * 10/2001 Leoncavallo ..... 222/83.5
6,412,526 B2 * 7/2002 Castillo ..... 141/100
7,484,633 B1 * 2/2009 Moher ..... 215/11.1
2005/0056608 A1 * 3/2005 Nesin ..... 215/11.1
2007/0084819 A1 4/2007 Fialkowski

* cited by examiner

*Primary Examiner*—Sue A Weaver

(57) ABSTRACT

The present invention is directed to a multi-functional bottle including a threaded cap, a protector seal, a tube member, a snap-off cap member, and a bottle to allow a person to have a multi-functional bottle that contains an optional cartridge for storing powdered products, e.g., baby formula, and/or solid objects such as lottery tickets or novelty items.

1 Claim, 7 Drawing Sheets

MULTI-FUNCTIONAL BOTTLE

FIELD OF THE INVENTION

The present invention is directed to a multi-functional bottle including a threaded cap, a protector seal, a tube member, a snap-off cap member, and a bottle to allow a person to have a multi-functional bottle that contains an optional cartridge for storing powdered products, e.g., baby formula, and/or solid objects such as lottery tickets or novelty items.

BACKGROUND OF THE INVENTION

An object of this invention is to provide a multi-functional bottle to allow a person to easily feed an infant without having to carry a bottle at all times. Another object of this invention is to provide a multi-functional bottle that includes a single cartridge for storing powdered products, e.g., baby formula, and/or solid objects such as lottery tickets or novelty items.

SUMMARY OF THE INVENTION

The present invention features a multi-functional bottle comprising a bottle having a neck that is outwardly threaded, the neck has an opening into the bottle, and a tube member having a diameter smaller than the opening of the neck so that the tube member can be inserted into the bottle. In some embodiments, the tube member has a first end and a second end. The first end of the tube member has a protruding lip that is bigger than the opening of the neck to suspend the tube member from the opening of the neck, the first end of the tube member also has an opening, and the second end of the tube member has a narrowing tip, wherein the tip is temporarily sealed off. The multi-functional bottle further comprises a baby nipple having a base ring that can fit and suspend the nipple at the first end of the tube member. The multi-functional bottle further comprises a cap having a partial top and an opening, the opening is sized to accommodate the nipple, the cap further has internal threading to secure the cap to the neck of the bottle. When assembled, the cap threads with the neck of the bottle wherein the partial top of the cap and the neck of the bottle sandwich therein between the nipple base ring and the protruding lip of the tube member.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims. For example, an adult may choose to remove the cartridge and drink the bottled solution (e.g., water, beverage, etc.)

DESCRIPTION OF PREFERRED EMBODIMENTS

Figure 1A:
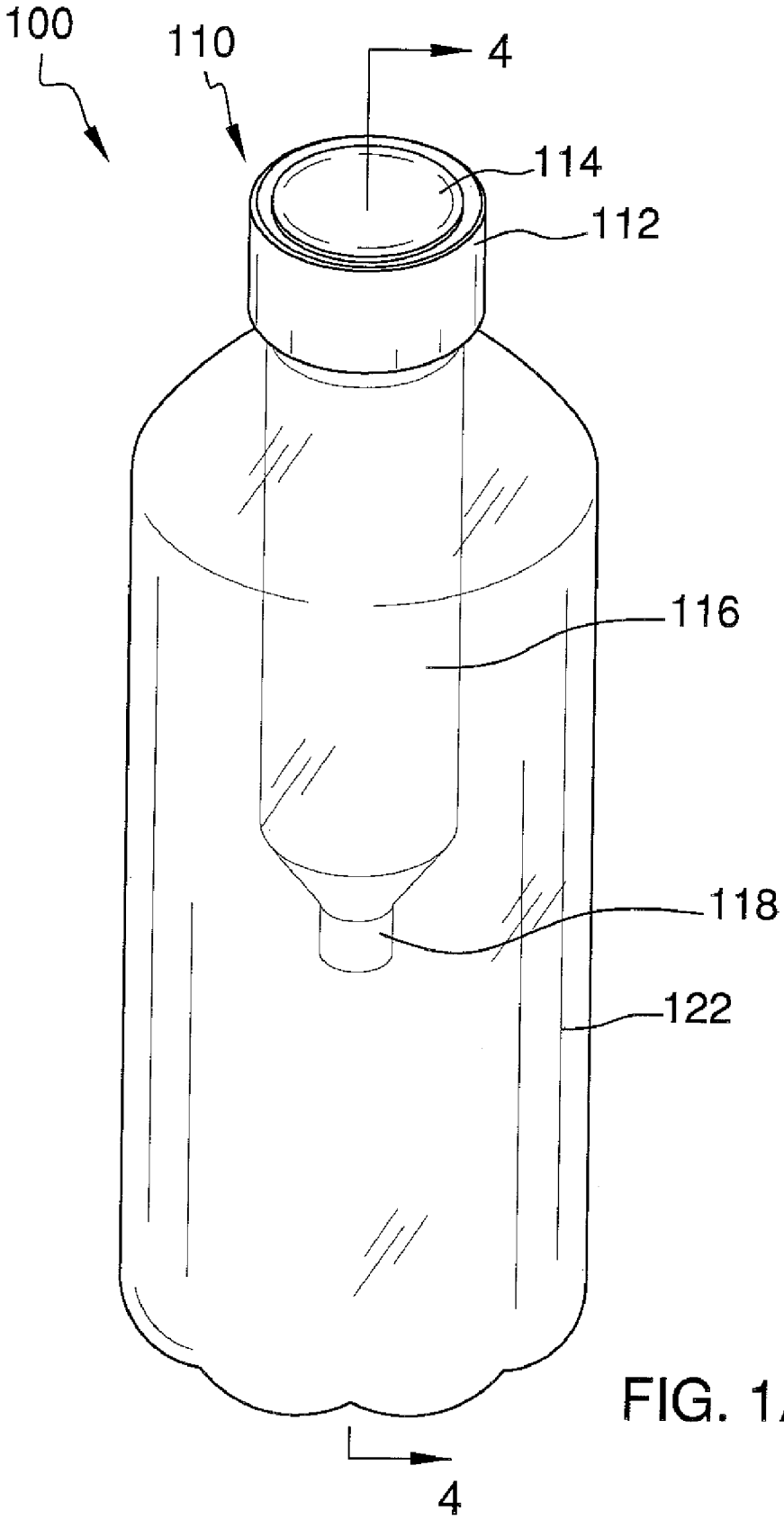
FIG. 1A is an illustration of a multi-functional bottle according to the invention including a threaded cap, a protector seal, a tube member, a snap-off cap member, and a bottle.

The present invention features a multi-functional bottle comprising a bottle 100 having a neck 312 that is outwardly threaded, where the neck has an opening into the bottle. The bottle also has a tube member 116 having a diameter 300 that is smaller than the diameter opening 310 of the neck so that the tube member can be inserted into the bottle 122. In some embodiments, the tube member 116 has a first end 320 and a second end 330. The first end 320 of the tube member has a protruding lip 340 that has a diameter that is bigger than the opening of the neck 310 to suspend the tube member 116 from the opening of the neck. The first end of the tube member also has an opening, and the second end of the tube member has a narrowing tip, wherein the tip is temporarily sealed off. The advantage of the narrowing tip is to facilitate pouring of the content of the tube member into the bottle without the content being spilled and wasted. The content of the tube member can be sealed off with a breakable tip, wherein breaking the tip allows the content of the tube member to be emptied. The content of the tube member can also be sealed off with a twist-off cap.

The multi-functional bottle further comprises a baby nipple 214 having a base ring 214*b* that can fit and suspend the nipple 214*a* at the first end of the tube member 320. The multi-functional bottle further comprises a cap 112 having a partial top 112*a* and an opening (aperture) 212, where the opening 212 is sized to accommodate the nipple 214. The cap further has internal threading to secure the cap 112 to the neck of the bottle 312. When assembled, the cap 112 threads with the neck 312 of the bottle wherein the partial top 112*a* of the cap and the neck 312 of the bottle sandwich therein between the nipple base ring 214*b* and the protruding lip of the tube member 340 (FIG. 3).

Figure 1B:
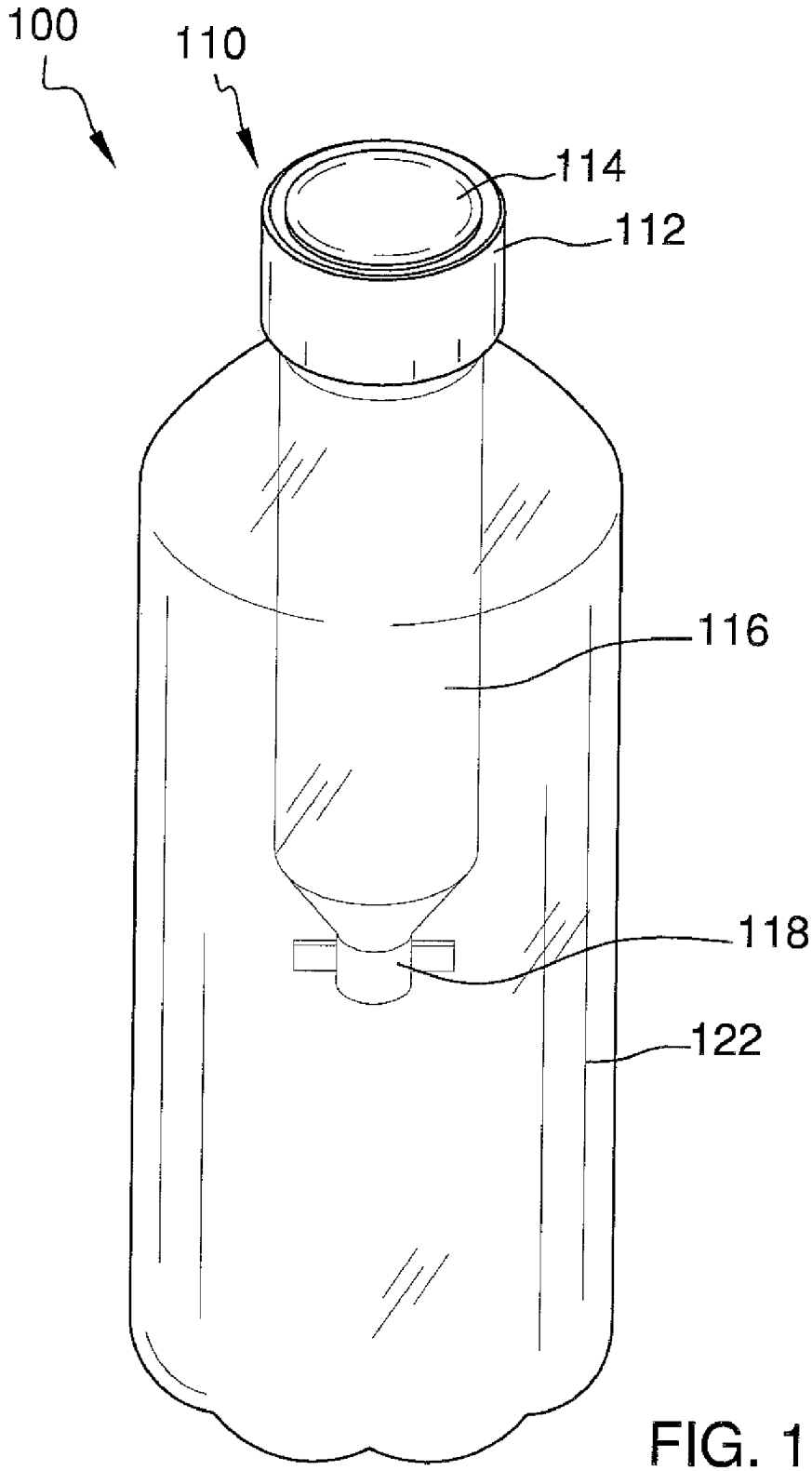
FIG. 1B shows that the snap-off cap member can further comprise a twist-off wing set.

Referring now to FIG. 1, multi-functional bottle 100 is shown comprising cap 110 and bottle 122. In the illustrated embodiment of FIG. 1, cap 110 comprises an internal threaded cap portion 112 to secure the cap onto the bottle, protector seal 114 to seal off the content of the cartridge, tube member 116 to hold various contents wherein the tube member has a narrowing tip which is smaller in diameter as compared to the diameter of the tube member 116, and snap-off cap member 118.

In the illustrated embodiment of FIG. 1, protector seal 114 seals off all outside elements that may contaminate multi-functional bottle 100. In the illustrated embodiment of FIG. 1, protector seal 114 comprises a standard peel-off tab known to one skilled in the art. In other embodiments, protector seal 114 comprises a standard rubber plug known to one skilled in the art. In the illustrated embodiment of FIG. 1, threaded cap portion 112 is attached to top threaded member (neck) 312 of bottle 122 (see FIG. 3A). In the illustrated embodiment of FIG. 1, tube member 116 sits housed within bottle 122. A person can pull off protector seal 114 and unscrew threaded cap portion 112 from top threaded member 312 (see FIGS. 2A and 2B). In the illustrated embodiment of FIG. 1, snap-off cap member 118 is removed from tube member 116 by way of perforated member 412 (see FIG. 4).

In certain embodiments, threaded cap portion 112 comprises a plastic material. In certain embodiments, threaded cap portion 112 comprises a standard threaded cap known to one skilled in the art. In certain embodiments, tube member 116 comprises a standard plastic tube known to one skilled in the art. In certain embodiments, snap-off cap member 118 comprises a standard perforated snap-off cap known to one skilled in the art. In certain embodiments, bottle 122 comprises a plastic material. In certain embodiments, bottle 122 comprises a standard bottle known to one skilled in the art.

Figure 2A:
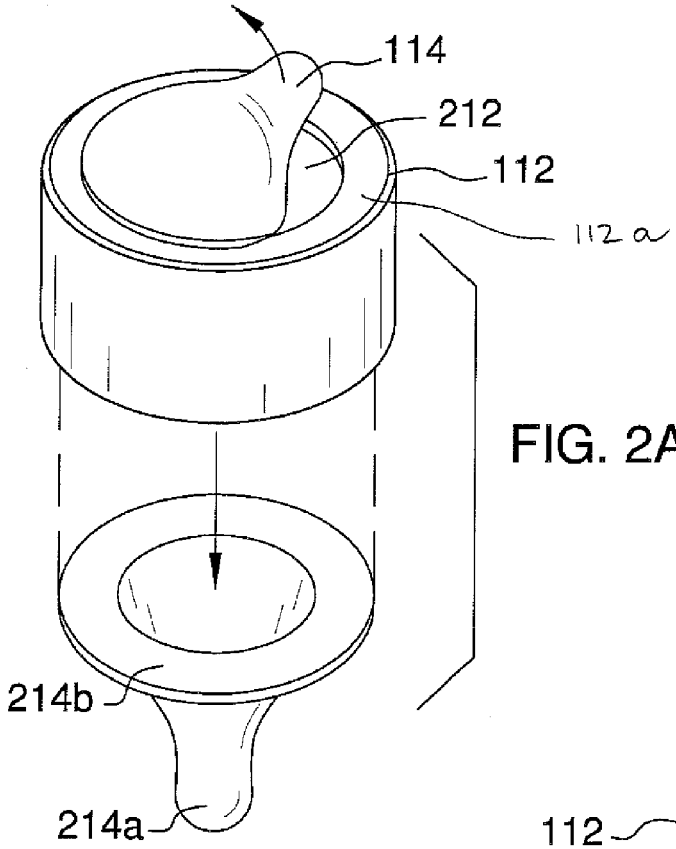
FIG. 2A is an illustration of the threaded cap and the protector seal of FIG. 1 including a nipple.

Referring now to FIG. 2A, threaded cap portion 112, protector seal 114, aperture 212, nipple 214*a*, and nipple ring 214*b* are shown. In the illustrated embodiment of FIG. 2A, a person can remove protector seal 114 from the top of threaded cap portion 112 to reveal aperture 212. In the illustrated embodiment of FIG. 2A, nipple 214*a* and nipple ring 214*b* are removed from the bottom of threaded cap portion 112. In certain embodiments, nipple 214*a* and nipple ring 214*b* comprises a standard bottle nipple and nipple ring.

Figure 2B:
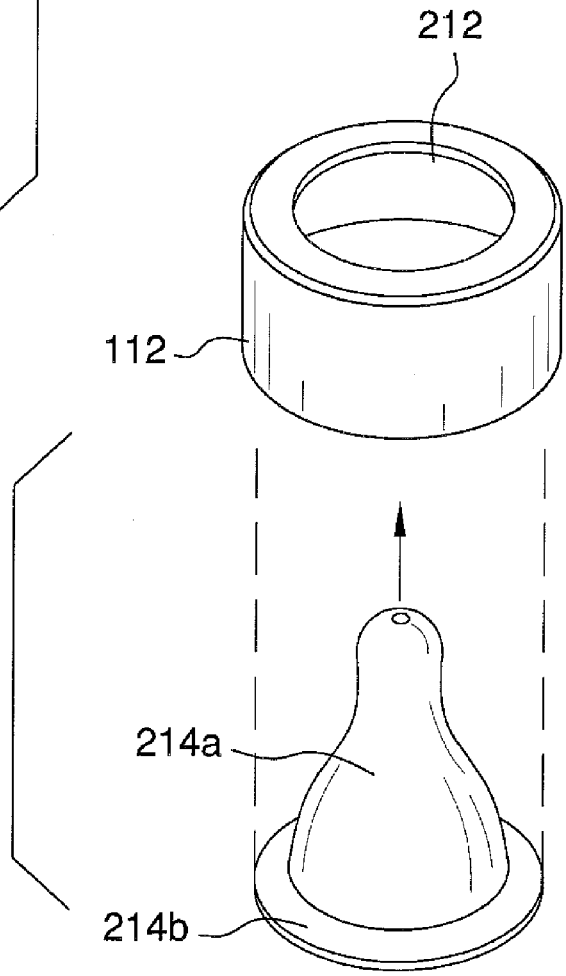
FIG. 2B is an illustration of the threaded cap, the protector seal, and the nipple of FIG. 2A as used.

Referring now to FIG. 2B, threaded cap portion 112, aperture 212, nipple 214*a*, and nipple ring 214*b* are shown. In the illustrated embodiment of FIG. 2B, a person can insert nipple 214*a* through aperture 212. In the illustrated embodiment of FIG. 2B, nipple ring 214*b* fits snuggly on the inner rim portion of threaded cap portion 112.

Figure 3A:
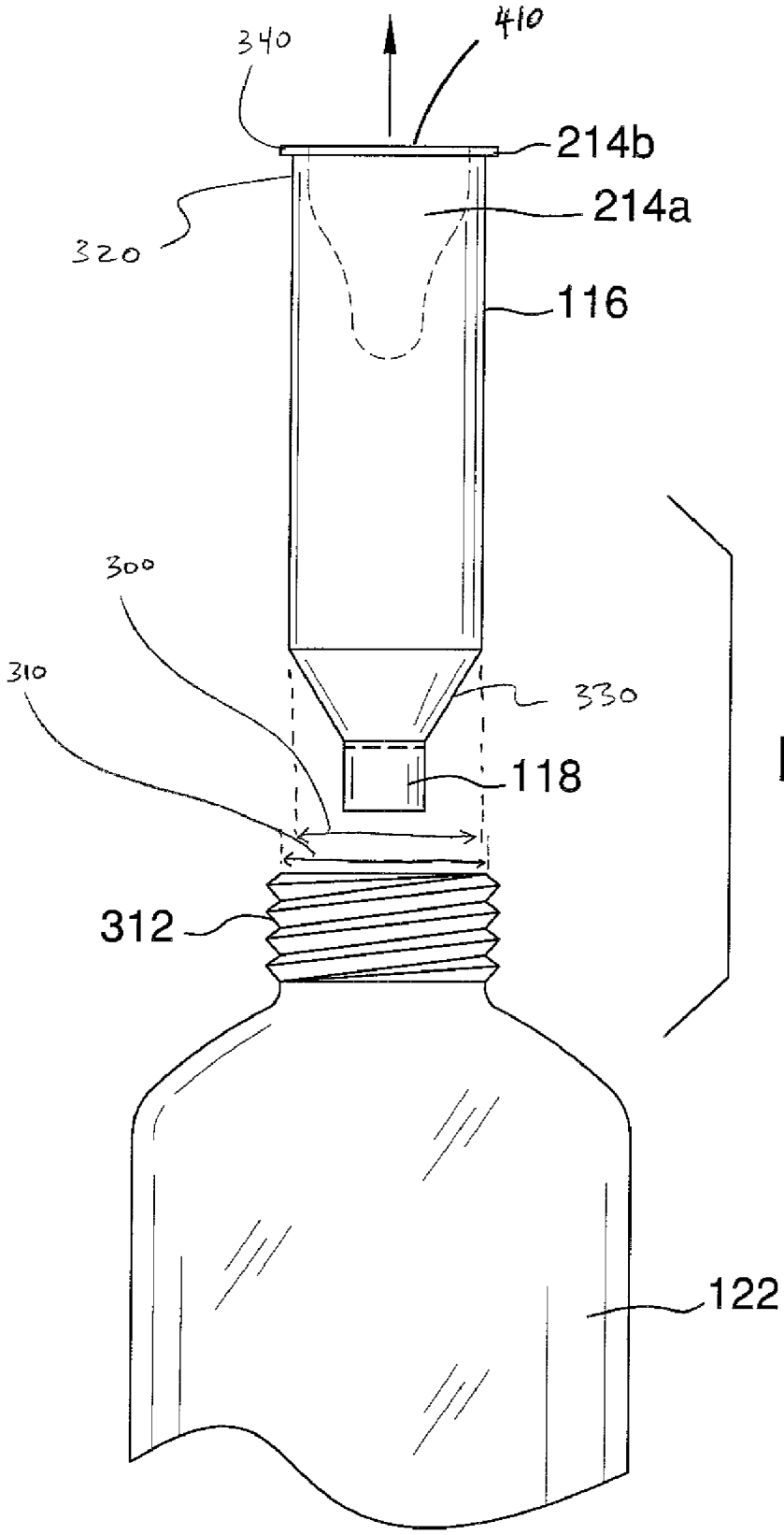
FIG. 3A is a side view of the multi-functional bottle of FIG. 1.

Referring now to FIG. 3A, tube member 116 is shown pulled out of bottle 122. In the illustrated embodiment of FIG. 3A, nipple 214*a* is housed within tube member 116. In the illustrated embodiment of FIG. 3A, nipple ring 214*b* rests on the upper ledge of tube member 116. In the illustrated embodiment of FIG. 3A, tube member 116 is removed from within bottle 122 after threaded cap portion 112 is unscrewed from top threaded member 312 (see FIGS. 2A and 2B).

Figure 3B:
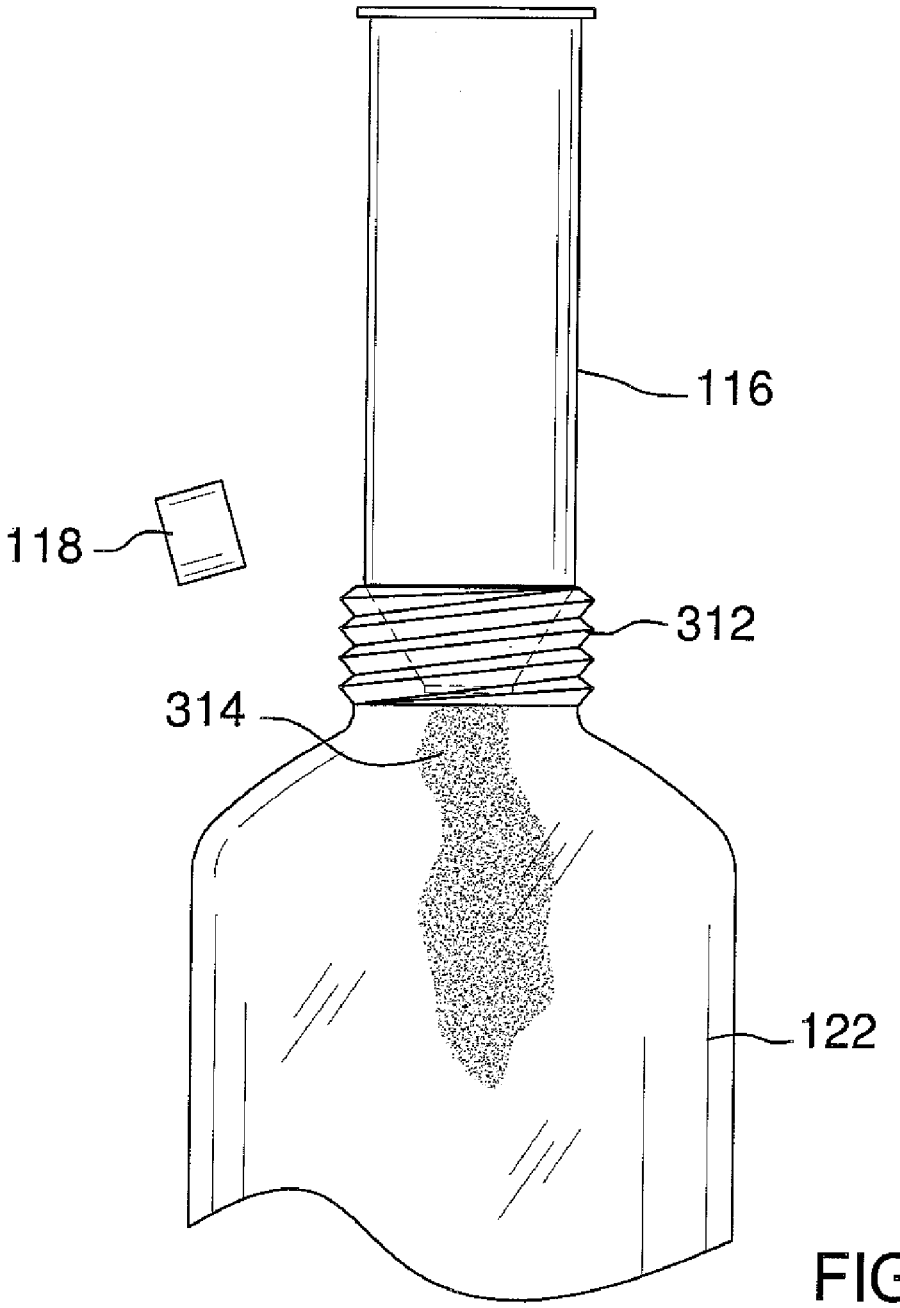
FIG. 3B is side view of the multi-functional bottle of FIG. 1 including the single cartridge of baby formula as used, wherein the cartridge comprises a narrow end.

Referring now to FIG. 3B, tube member 116 is shown pulled out of bottle 122. In the illustrated embodiment of FIG. 3A, tube member 116 is removed from within bottle 122 after threaded cap portion 112 is unscrewed from top threaded member 312 (see FIGS. 2A and 2B). In the illustrated embodiment of FIG. 3B, single serving of baby powder 314 is stored in tube member 116. In the illustrated embodiment of FIG. 3B, snap-off cap member 118 is removed from the bottom of tube member 116 to allow a single serving of powder product 314 (e.g., baby powder or other powdered products) to be poured into bottle 122. A person can add water to produce a mixed solution, e.g. a mixed beverage.

Figure 4:
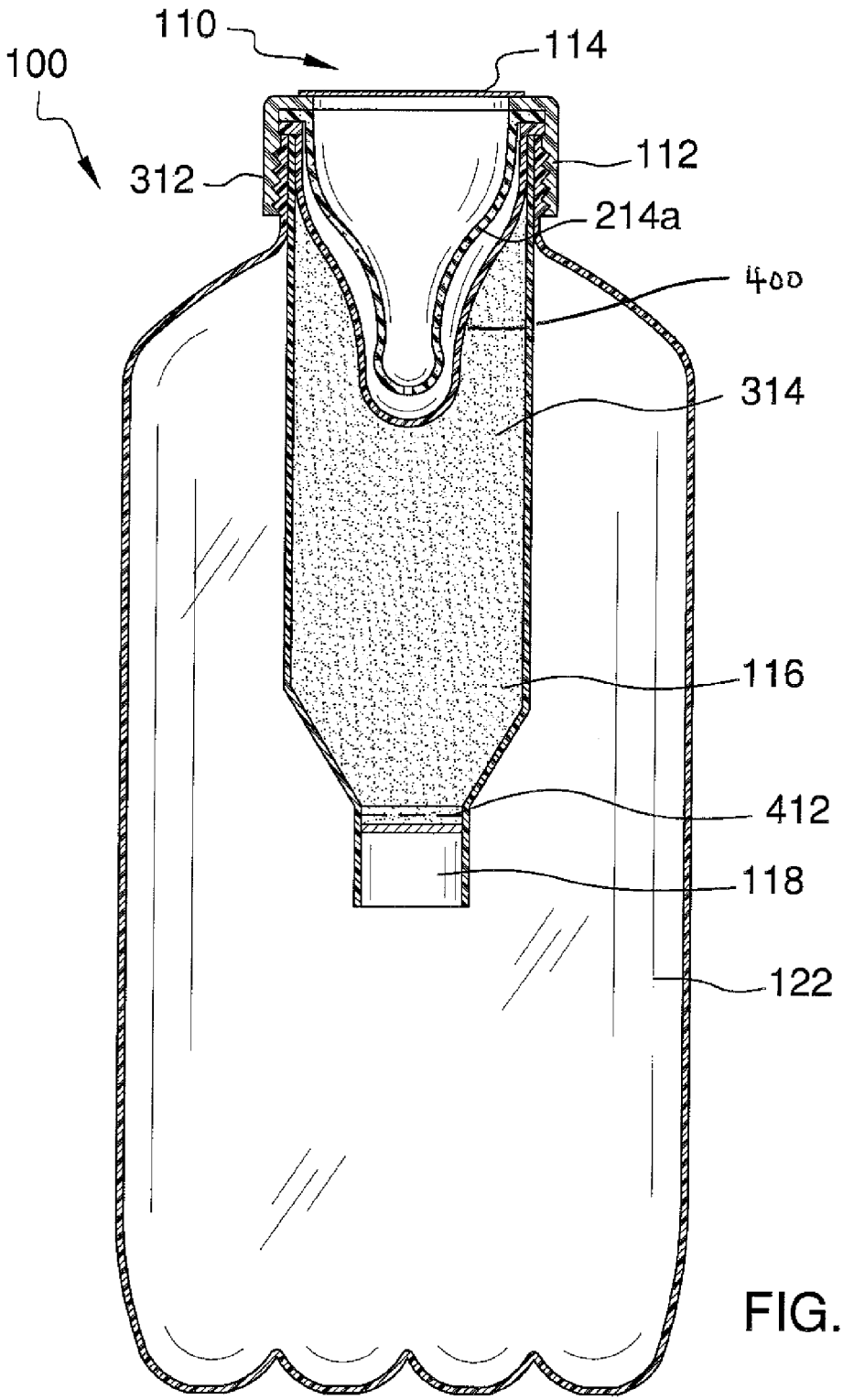
FIG. 4 is a front cross section view of the multi-functional bottle of FIG. 1.

Referring now to FIG. 4, a front cross section view of multi-functional bottle 100 is shown comprising cap 110 and bottle 122. In the illustrated embodiment of FIG. 4, cap 110 comprises threaded cap portion 112, protector seal 114, tube member 116, and snap-off cap member 118. In the illustrated embodiment of FIG. 4, protector seal 114 seals off all outside elements that may contaminate multi-functional bottle 100. In the illustrated embodiment of FIG. 4, protector seal 114 comprises a standard peel-off tab known to one skilled in the art. In other embodiments, protector seal 114 comprises a standard rubber plug known to one skilled in the art. In the illustrated embodiment of FIG. 1, threaded cap portion 112 is attached to top threaded member 312 of bottle 122 (see FIG. 3A). In the illustrated embodiment of FIG. 4, tube member 116 sits housed within bottle 122. In the illustrated embodiment of FIG. 4, nipple 214*a* is housed within tube member 116. In the illustrated embodiment of FIG. 4, single serving of baby powder 314 is stored in tube member 116. A person can pull off protector seal 114 and unscrew threaded cap portion 112 from top threaded member 312 (see FIGS. 2A and 2B). In the illustrated embodiment of FIG. 4, snap-off cap member 118 is removed from tube member 116 by way of perforated member 412.

Figure 5:
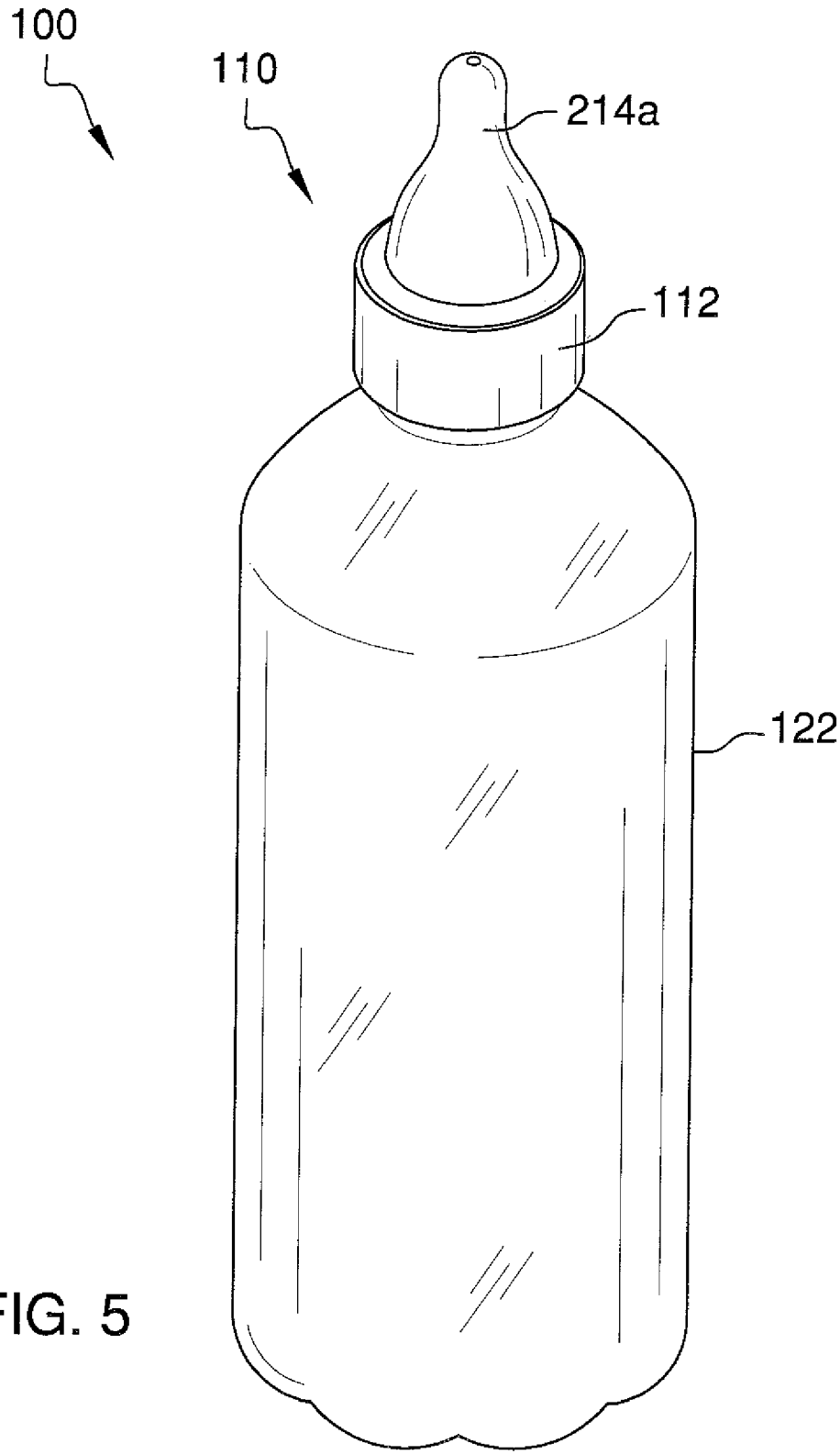
FIG. 5 is an illustration of the multi-functional bottle of FIG. 1.

Referring now to FIG. 5, multi-functional bottle 100 is shown comprising cap 110 and bottle 122. In the illustrated embodiment of FIG. 5, multi-functional bottle 100 is shown after a person has removed tube member 116 from within bottle 122 and poured single serving of powdered product 314 (e.g., baby powder, etc.) within bottle 122 (see FIGS. 3A and 3B).

In certain embodiments, tube member 116 contains a supplemental powder for an adult. In certain embodiments, tube member 116 houses a drinking straw. In certain embodiments, a person can remove protector seal 114 from threaded cap 112 and insert the drinking straw through aperture 212 (see FIGS. 2A and 2B). In certain embodiments, a person can pour the supplemental powder into bottle 122 to provide a liquid adult drink.

In some embodiments, the opening of the first end of the tube member 410 is sealed off by a protector seal 114. In some embodiments, the tube member further comprises a partitioning member 400 to form two compartments, wherein the first compartment holds the nipple 214 and the second compartment holds the cartridge content 314. In some embodiments, the content of the cartridge 314 is a solid object, such as, for example, a lottery ticket, a novelty item, and/or a medication. In some embodiments, after the content 314 of the tube member is removed, the tube member can be reused for storing valuables and the like.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A multi-functional bottle comprising:

(a) a bottle having a neck that is outwardly threaded, the neck has an opening into the bottle, (b) a tube member having a diameter smaller than the opening of the neck so that the tube member can be inserted into the bottle, the tube member has a first end and a second end, (i) the first end of the tube member has a protruding lip that is bigger than the opening of the neck to suspend the tube member from the opening of the neck, the first end of the tube member also has an opening, (ii) the second end of the tube member has a narrowing tip, wherein the tip is temporarily sealed off, (c) a baby nipple having a base ring that can fit and suspend the nipple at the first end of the tube member, (d) a cap having a partial top and an opening, the opening is sized to accommodate the nipple, the cap further has internal threading to secure the cap to the neck of the bottle, when assembled, the cap threads with the neck of the bottle wherein the partial top of the cap and the neck of the bottle sandwiches therein between the nipple base ring and the protruding lip of the tube member, wherein the tube member further comprises a partitioning member to form a first compartment and a second compartment, the first compartment is sized to hold the nipple, the first compartment is accessible via only the first end of the tube member, the second compartment holds a cartridge content, the second compartment is accessible via only the second end of the tube member.

* * * * *